US007195135B1

(12) United States Patent
Garcia et al.

(10) Patent No.: US 7,195,135 B1
(45) Date of Patent: Mar. 27, 2007

(54) DISPENSER HAVING A HINGED DISPENSING HEAD

(75) Inventors: Firmin Garcia, Evreux (FR); Laurent Decottignies, Cergy (FR)

(73) Assignee: Valois S.A.S, Neubourg (FR)

( * ) Notice: Subject to any disclaimer, the term of this patent is extended or adjusted under 35 U.S.C. 154(b) by 438 days.

(21) Appl. No.: 10/048,056

(22) PCT Filed: Jul. 26, 2000

(86) PCT No.: PCT/FR00/02149

§ 371 (c)(1),
(2), (4) Date: Oct. 17, 2003

(87) PCT Pub. No.: WO01/09008

PCT Pub. Date: Feb. 8, 2001

(30) Foreign Application Priority Data

Jul. 29, 1999 (FR) ..... 99 09868

(51) Int. Cl.
*B67D 5/52* (2006.01)

(52) U.S. Cl. ..... 222/137

(58) Field of Classification Search ..... 222/137
See application file for complete search history.

(56) References Cited

U.S. PATENT DOCUMENTS

| | | | | |
|---|---|---|---|---|
| 3,236,457 A | | 2/1966 | Kennedy et al. | |
| 4,773,562 A | | 9/1988 | Gueret | |
| 5,290,259 A | * | 3/1994 | Fischer | 222/137 |
| 5,301,841 A | | 4/1994 | Fuchs | |
| 5,411,176 A | * | 5/1995 | Favre | 222/137 |
| 5,429,301 A | | 7/1995 | Franks | |

FOREIGN PATENT DOCUMENTS

| | | |
|---|---|---|
| EP | 0 313 414 A1 | 4/1989 |
| EP | 0 734 781 A1 | 10/1996 |

* cited by examiner

*Primary Examiner*—Philippe Derakshani
(74) *Attorney, Agent, or Firm*—Sughrue Mion, PLLC

(57) ABSTRACT

A fluid dispenser having two dispensing members (11, 21) mounted on two reservoirs (10, 20), each dispensing member being provided with a dispensing head (12, 22) through which fluid is caused to flow by pressing on a common pusher (3). The two dispensing heads are interconnected via a flexible spacer (13).

9 Claims, 1 Drawing Sheet

DISPENSER HAVING A HINGED DISPENSING HEAD

The present invention relates to a fluid dispenser comprising two dispensing members mounted on two distinct reservoirs. Each dispensing member is provided with a dispensing head through which fluid is caused to flow by pressing on a common pusher. This type of dispenser, which may be referred to as a "twin dispenser" is used when two different fluids are to be dispensed, e.g. two fluids that are incompatible or reactive with each other or that are of different colors. The dispenser is thus made up of two distinct dispensers that can be actuated simultaneously by means of the common pusher on which it is necessary to push with one or more fingers to actuate the two dispensing members (which can be pumps or valves) at the same time.

To generate dispensing that is localized at the outlet of the dispenser, the outlet ducts of the two pumps or valves must meet or be situated very close together at their outlet orifices. Since dispensing heads are generally made of molded plastics, this raises technical complications at the molding stage, in particular as regards the use of core pins for forming the internal outlet ducts.

An object of the present invention is to provide a dispensing head assembly for a twin dispenser, which assembly is easy to mold and easy to mount on the dispensing members.

To this end, the present invention provides a fluid dispenser comprising two dispensing members mounted on two reservoirs, each dispensing member being provided with a dispensing head through which fluid is caused to flow by pressing on a common pusher, said fluid dispenser being characterized in that the two dispensing heads are interconnected via a flexible spacer. The term "flexible spacer" is used also to cover any hinged link means making it possible for the two heads to be displaced angularly relative to each other, advantageously in a horizontal plane. By means of this flexible spacer, the two dispensing heads can be molded integrally with the flexible spacer interconnecting them while in a position such that the outlet ducts extend parallel to each other and not with an angle between them which would give rise to complications with the molding pins. Therefore, the two heads are molded parallel to each other and they are then stressed to bring their outlet orifices side by side by deforming the flexible spacer. Advantageously, the common pusher is provided with locking means for holding the dispensing heads stationary with their orifices adjacent to each other. Thus, with the complications related to adding the flexible spacer being minimized, it is easy to mold the two dispensing heads without any difficulty as regards the molding technique. Moreover, the design of the common pusher is also simplified because it no longer incorporates the dispensing heads unlike certain prior art configurations.

According to another characteristic, the common pusher forms a common outlet orifice to which the outlet orifices of the two heads are connected.

The invention is described more fully below with reference to the accompanying drawing giving an embodiment of the invention by way of non-limiting example.

Figure 2:
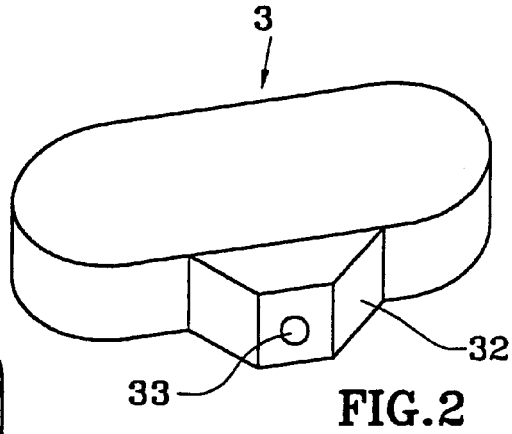
FIG. 2 is a diagrammatic perspective view of a variant pusher incorporating a common outlet orifice.
Figure 3A:
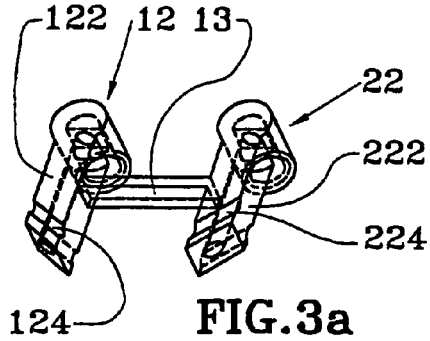
Figure 3B:
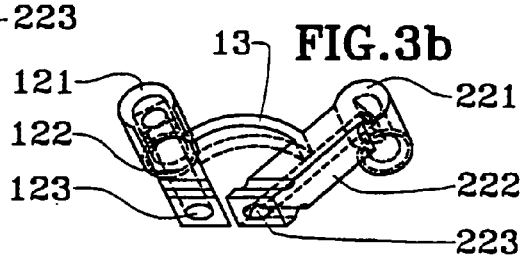
Figure 4:
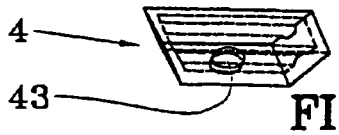
Figure 5:
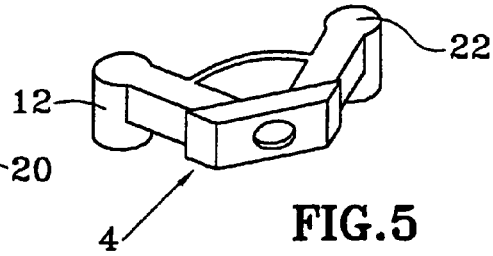

FIG. 3*a* is a transparent perspective view of the dispensing heads in the rest state as they come out of the mold;

FIG. 3*b* is a view of the dispensing heads of FIG. 2*a*, as stressed to bring the outlet orifices side by side, and suitable for being mounted on the dispensing members of the dispenser;

FIG. 4 is a transparent perspective view of a common outlet orifice end-piece to be mounted on the dispensing heads; and FIG. 5 is a diagrammatic perspective view of the dispensing heads with the end-piece of FIG. 4 mounted on them.

Figure 1:
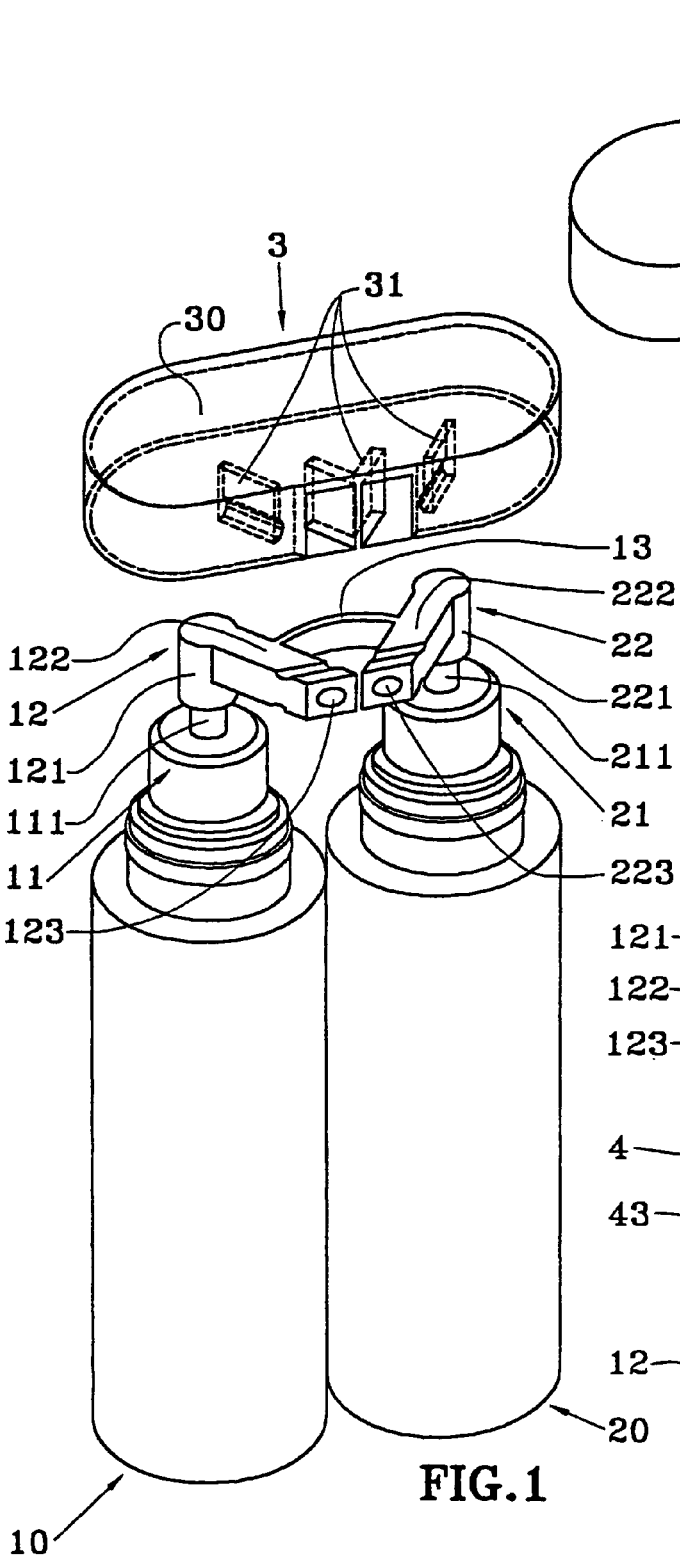
FIG. 1 is a diagrammatic perspective view of a dispenser of the invention with a common pusher shown in transparent exploded view.

Like any "twin dispenser", the dispenser of the invention includes two distinct reservoirs 10 and 20 containing respective fluids of different types, colors, viscosities, fragrances, etc. Each reservoir 10, 20 underlies a dispensing member 11, 21 which may be a pump or a valve. Conventionally, each dispensing member is provided with an actuating rod 111, 211 which projects upwards and on which it is necessary to press in order to actuate the dispensing member. Each actuating rod 111, 211 underlies a dispensing head 12, 22 through which fluid flows when the actuating rod 111, 211 is pushed in. More precisely, each dispensing head includes a connection sleeve 121, 221 that is generally engaged by force onto the top end of the actuating rod 111, 211, and an outlet duct 122, 222 which, in this example, extends substantially horizontally and which defines a hollow inside that opens out at 123, 223, thus forming fluid outlet orifices. As can be seen in FIG. 1, the two outlet ducts 122, 222 form an angle between them so that their outlet orifices 123, 223 are situated side by side. Optionally, it is possible to mount an end-piece 4 on the two orifices 123 and 223, which end-piece defines a common outlet orifice 43, as can be seen in FIGS. 4 and 5.

In the invention, the two dispensing heads 12, 22 are connected together via flexible hinge means, implemented, in this example, in the form of a flexible spacer 13. In this example, the flexible spacer 13 interconnects the two outlet ducts 122, 222 substantially at their middles, but it is also possible to devise other embodiments in which the flexible spacer 13 interconnects either the two connection sleeves 121, 221 or else the two ducts 122, 222 in the vicinities of their outlet orifices 123, 223, as can be seen in FIG. 3.

Finally, the dispenser includes a common pusher 3 defining a push top surface 30 on which it is necessary to press with one or more fingers in order to actuate the two dispensing members simultaneously. According to a characteristic of the invention, the common pusher 3 is provided with locking means which, in this example, are in the form of clamping plates 31, and which make it possible to hold the outlet heads stationary with their orifices adjacent, as shown in FIG. 1. For this purpose, the clamping plates 31 are angularly positioned to form channels in which the outlet ducts 122, 222 are inserted and to lock them in the inserted position. In a variant shown in FIG. 2, the pusher may define an end-piece 32 in which a common outlet orifice 33 is formed.

According to an advantageous characteristic of the invention, the two dispensing heads 12, 22 are molded integrally with their flexible spacer that interconnects them in the position shown in FIG. 3*a*, i.e. with their outlet ducts 122, 222 extending parallel to each other. In this configuration, the flexible spacer is not under stress, and it extends substantially rectilinearly. Because the two outlet ducts are parallel, this makes it easier to insert the molding pins, given that they can be displaced parallel to each other, rather than crossing each other as they often do in the prior art. The dispensing heads are thus molded in the configuration shown in FIG. 3*a*, and they are then stressed by elastically deforming the flexible spacer so that they are brought into the position shown in FIG. 3*b*, in which the two outlet orifices 123, 223 are situated side by side. In this position, the two dispensing heads can be mounted on the dispensing members 11, 21 or more precisely engaged onto the actuating rods 111, 211. Naturally, the length of the flexible spacer 13 must be determined so that, in the stressed state shown in FIG. 3*b*, the two outlet orifices 123, 223 are situated side by side, and so that the two connection sleeves 121, 221 have spacing equal to the spacing between the actuating rods 111, 211. Once the heads have being mounted on the dispensing members, it is necessary merely to put the common pusher in place so as to lock them permanently in this position by means of the locking plates 31.

Thus, a "twin dispenser" is obtained whose dispensing heads are easy to mold, and, in addition, the common pusher is also easy to mold since it no longer incorporates the dispensing heads.

The invention claimed is:

1. A fluid dispenser comprising two dispensing members (11, 21) mounted on two reservoirs (10, 20), each dispensing member being provided with a dispensing head (12, 22) through which fluid is caused to flow by pressing on a common pusher (3), wherein the two dispensing heads are interconnected via a flexible spacer (13) so that the two dispensing heads are displaceable relative to each other by deformation of the spacer in order to vary the relative angle between the heads.

2. A fluid dispenser according to claim 1, in which each dispensing head (12, 22) comprises an outlet duct (122, 222) provided at one end with a connection sleeve (121, 221) for connecting it to the dispensing member (11, 12), and defining at the other end an outlet orifice (123, 223), an angle being formed between the two ducts by bending the flexible spacer so that the two outlet orifices are mutually adjacent.

3. A fluid dispenser according to claim 2, in which the dispensing heads are molded with their outlet ducts extending parallel to each other.

4. A fluid dispenser according to claim 2, in which the pusher (3) is provided with locking means (31) for holding the dispensing heads stationary with their orifices adjacent to each other.

5. A dispenser according to claim 1, in which a common outlet orifice (33) is connected to the outlet orifices (123, 223) of the two heads.

6. A fluid dispenser according to claim 1, in which the pusher (3) forms an outlet orifice to which the outlet orifices of the two heads are connected.

7. A fluid dispenser comprising:

a first dispensing member mounted on a first reservoir, the first dispensing member comprising a first dispensing head;

a second dispensing member mounted on a second reservoir, the second dispensing member comprising a second dispensing head;

a pusher common to the first dispensing head and the second dispensing head, so that depressing the pusher causes fluid to flow from the first dispensing head and the second dispensing head; and a spacer connecting the first dispensing head to the second dispensing head, the spacer is flexible so that the first dispensing head and the second dispensing head are rotatably displaceable relative to each other upon deformation of the spacer, thereby varying a relative angle between the first dispensing head and the second dispensing head with respect to a vertical axis of the dispenser that extends parallel to an actuation direction of the dispenser.

8. The dispenser according to claim 7, wherein the spacer is a flexible strip extending directly between the first dispensing head and the second dispensing head and in a lateral direction transverse to an actuation direction of the dispenser.

9. A fluid dispenser comprising two dispensing members (11, 21) mounted on two reservoirs (10, 20), each dispensing member being provided with a dispensing head (12, 22) through which fluid is caused to flow by pressing on a common pusher (3); wherein the two dispensing heads are interconnected via a flexible spacer (13); and wherein the pusher (3) is provided with locking means (31) for holding the dispensing heads stationary with their orifices adjacent to each other.

* * * * *